US010513417B2

(12) United States Patent
Zhao et al.

(10) Patent No.: US 10,513,417 B2
(45) Date of Patent: Dec. 24, 2019

(54) ELEVATOR SYSTEM USING PASSENGER CHARACTERISTIC INFORMATION TO GENERATE CONTROL COMMANDS

(71) Applicant: Otis Elevator Company, Farmington, CT (US)

(72) Inventors: Jianwei Zhao, Shanghai (CN); Qiang Li, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 696 days.

(21) Appl. No.: 15/183,245

(22) Filed: Jun. 15, 2016

(65) Prior Publication Data

US 2016/0368732 A1 Dec. 22, 2016

(30) Foreign Application Priority Data

Jun. 16, 2015 (CN) ..... 2015 1 0331415

(51) Int. Cl.
*B66B 1/34* (2006.01)
*B66B 1/46* (2006.01)
*B66B 5/00* (2006.01)

(52) U.S. Cl.
CPC ..... *B66B 1/468* (2013.01); *B66B 1/3476* (2013.01); *B66B 5/0012* (2013.01); (Continued)

(58) Field of Classification Search
CPC ..... B66B 1/3476; B66B 5/0012; B66B 1/468; B66B 2201/222; B66B 2201/405; (Continued)

(56) References Cited

U.S. PATENT DOCUMENTS 4,951,786 A * 8/1990 Haraguchi ..... B66B 1/3484 187/391
5,131,508 A 7/1992 Suzuki
(Continued)

FOREIGN PATENT DOCUMENTS

CN 1442814 A 9/2003
CN 1736840 A 2/2006
(Continued)

OTHER PUBLICATIONS

European Search Report for application EP 16174747, dated Nov. 7, 2016, 9 pgs.
(Continued)

*Primary Examiner* — Anthony J Salata
(74) *Attorney, Agent, or Firm* — Cantor Colburn LLP

(57) ABSTRACT

An elevator system comprises a first information collection device disposed in a passenger waiting area of the elevator system and used for acquiring first passenger characteristic information; a second information collection device used for acquiring second passenger characteristic information inside the car; an information analysis and processing device that receives the first passenger characteristic information and the second passenger characteristic information, is configured to perform analysis and processing, based on the first passenger characteristic information, so as to transmit a first control command for dispatching the elevator, is configured to perform analysis and processing on the first passenger characteristic information to acquire classification information of a passenger and to further transmit, based on the classification information, a second control command that is applicable for passengers in a corresponding classification, and is further configured to dynamically transmit, based on the second passenger characteristic information, a third control command.

20 Claims, 4 Drawing Sheets

(52) U.S. Cl.
CPC ... *B66B 2201/222* (2013.01); *B66B 2201/405* (2013.01); *B66B 2201/4638* (2013.01); *B66B 2201/4661* (2013.01); *B66B 2201/4669* (2013.01)

(58) Field of Classification Search
CPC .... B66B 2201/4638; B66B 2201/4661; B66B 2201/4669
USPC ..... 187/247, 380–388, 391, 392, 395, 396
See application file for complete search history.

(56) References Cited

U.S. PATENT DOCUMENTS 5,258,587 A 11/1993 Kezer et al.
5,387,768 A * 2/1995 Izard ..... G06F 7/00 187/392
5,487,451 A * 1/1996 Hughes ..... B66B 1/18 187/392
6,109,396 A * 8/2000 Sirag ..... B66B 1/468 187/381
6,578,675 B2 6/2003 Wilson et al.
6,615,175 B1 9/2003 Gazdzinski
7,079,669 B2 * 7/2006 Hashimoto ..... B66B 1/468 187/247
7,140,469 B2 11/2006 Deplazes et al.
7,162,233 B2 1/2007 Chiba
7,382,895 B2 * 6/2008 Bramblet ..... G07C 9/00 382/103
7,552,800 B2 6/2009 Puskala et al.
7,581,622 B2 9/2009 Amano
7,712,586 B2 * 5/2010 Legez ..... B66B 1/20 187/387
7,743,891 B2 6/2010 Tyni et al.
7,823,700 B2 * 11/2010 Boss ..... B66B 1/468 187/247
7,823,703 B2 11/2010 Amano
7,913,820 B2 3/2011 Sakurai
8,020,672 B2 * 9/2011 Lin ..... B66B 1/34 187/316
8,136,636 B2 3/2012 Bahjat et al.
8,151,943 B2 4/2012 De Groot
8,334,906 B2 12/2012 Lipton et al.
8,487,772 B1 7/2013 Higgins
8,584,811 B2 * 11/2013 Kuoppala ..... B66B 1/468 187/316
8,662,257 B2 * 3/2014 Chasteen ..... B66B 1/34 187/316
8,757,329 B2 * 6/2014 Taiana ..... B66B 1/468 187/391
9,016,440 B2 4/2015 Finschi
9,079,751 B2 * 7/2015 Sundholm ..... B66B 1/2458
9,988,238 B2 * 6/2018 Simcik ..... B66B 1/468
10,017,355 B2 * 7/2018 Silvennoinen ..... B66B 1/468
10,131,518 B2 * 11/2018 Vuorenala ..... B66B 3/006
2004/0188182 A1 * 9/2004 Walters ..... B66B 11/0226 187/247
2004/0262093 A1 12/2004 Forsythe et al.
2011/0251725 A1 10/2011 Chan
2012/0168262 A1 7/2012 Finschi
2012/0305340 A1 12/2012 Wu
2013/0168191 A1 7/2013 Mason
2015/0019340 A1 1/2015 El-Masri et al.
2015/0096843 A1 4/2015 Siddiqui et al.
2015/0114763 A1 4/2015 Kim et al.
2016/0368734 A1 * 12/2016 Zhao ..... B66B 5/0012

FOREIGN PATENT DOCUMENTS

CN 101402427 A 4/2009
CN 201376824 Y 1/2010
CN 103010874 A 4/2013
CN 104010957 A 8/2014
CN 104401823 A 3/2015
JP 2010083647 A 4/2010
JP 2013103795 A 5/2013
JP 2013230922 A 11/2013
KR 20110028703 A 3/2011
TW 200608259 3/2006
WO 2014122357 A1 8/2014

OTHER PUBLICATIONS

Chinese First Office Action for application 201510331415.1, dated May 24, 2019, 11 pages.

* cited by examiner

ELEVATOR SYSTEM USING PASSENGER CHARACTERISTIC INFORMATION TO GENERATE CONTROL COMMANDS

PRIORITY

This application claims priority to Chinese Patent Application No. 2151331415.1, filed Jun. 16, 215, and all the benefits accruing therefrom under 35 U.S.C. § 119, the contents of which in its entirety are herein incorporated by reference.

FIELD OF THE INVENTION

The present invention relates to the field of elevator control technologies, and to an elevator system that provides better experience for passengers and a control method thereof.

BACKGROUND OF THE INVENTION

Elevator systems have been extensively used in various buildings, and people have been continuously seeking better elevator riding experience. Whether an elevator system can provide good riding experience directly influences a passenger's first impression of the building or even a company in the building.

Often times, existing elevator systems can only meet conventional demands by passengers, for example, when a passenger sends an elevator call request in a waiting area, an elevator system schedules the running of cars thereof according to unified orders, thereby providing relatively standardized operation services. As a result, an existing elevator system is unable to provide personalized services, and moreover, is unable to provide corresponding advanced services to VIPs. In addition, it has a low operating efficiency, is unable to promptly identify potential safety risks or safety issues that have already taken place, and is not intelligent enough.

In light of the above, it is necessary to propose an elevator system and a control method thereof to improve user experience, for example, providing VIP-level user experience throughout the process from a passenger starting to wait for an elevator to leaving the elevator.

SUMMARY OF THE INVENTION

One object of the present invention is to make operations of an elevator system more intelligent.

Another object of the present invention is to improve a user's elevator riding experience.

To attain the above objects or other objects, the present invention provides the following technical solutions.

According to one aspect of the present invention, an elevator system is provided, which comprises a car and an elevator control device, and further comprises:

a first information collection device that is disposed in a passenger waiting area of the elevator system and used for at least acquiring first passenger characteristic information of the passenger waiting area;

a second information collection device that is used for at least acquiring second passenger characteristic information inside the car;

an information analysis and processing device that at least receives the first passenger characteristic information and the second passenger characteristic information, is configured to perform analysis and processing, at least based on the first passenger characteristic information, so as to transmit a first control command for dispatching the elevator to the elevator control device, is configured to perform analysis and processing on the first passenger characteristic information so as to at least acquire classification information of a passenger and to further transmit, based on the classification information, a second control command that is applicable for passengers in a corresponding classification to the elevator control device, and is further configured to dynamically transmit, based on the second passenger characteristic information, a third control command to the elevator control device.

According to another aspect of the present invention, an elevator system control method is provided, comprising:

at least acquiring first passenger characteristic information of the passenger waiting area;

at least acquiring second passenger characteristic information inside the car;

performing analysis and processing, based on the first passenger characteristic information, so as to transmit a first control command for dispatching the elevator;

performing analysis and processing on the first passenger characteristic information so as to at least acquire classification information of a waiting passenger and to further transmit a second control command that is applicable for passengers in a corresponding classification;

dynamically transmitting, based on the second passenger characteristic information, a third control command

BRIEF DESCRIPTION OF THE DRAWINGS

The above and other objects and advantages of the present invention will become more complete and clearer through the following detailed description with reference to the accompanying drawings, wherein identical or similar elements are represented by the same legends.

DESCRIPTION OF THE SPECIFIC EMBODIMENTS

Some of a plurality of potential embodiments of the present invention will be described, which are intended to provide a basic understanding of the present invention, and are not intended to confirm critical or key elements of are intended to or to limit the protection scope of the present invention. It shall be understood that those skilled in the art may propose other exchangeable implementations according to the technical solutions of the present invention without departing from the essence and spirit of the present invention. Therefore, the following specific embodiments and accompanying drawings are only exemplary description of the technical solutions of the present invention, and shall not be construed as all of the present invention or construed as restrictions or limitations to the technical solutions of the present invention.

To make the following description clear and concise, not all parts of an elevator system are shown in the figures. The figures highlight a plurality of parts for those skilled in the art to completely implement the present invention. For those skilled in the art, operations of many parts are familiar and obvious.

"Passenger waiting area" and "passenger arriving area" herein are defined relative to the elevator riding process of a passenger. A floor may be either a "passenger waiting area" in one elevator riding process, or a "passenger arriving area" in another elevator riding process.

Figure 1:
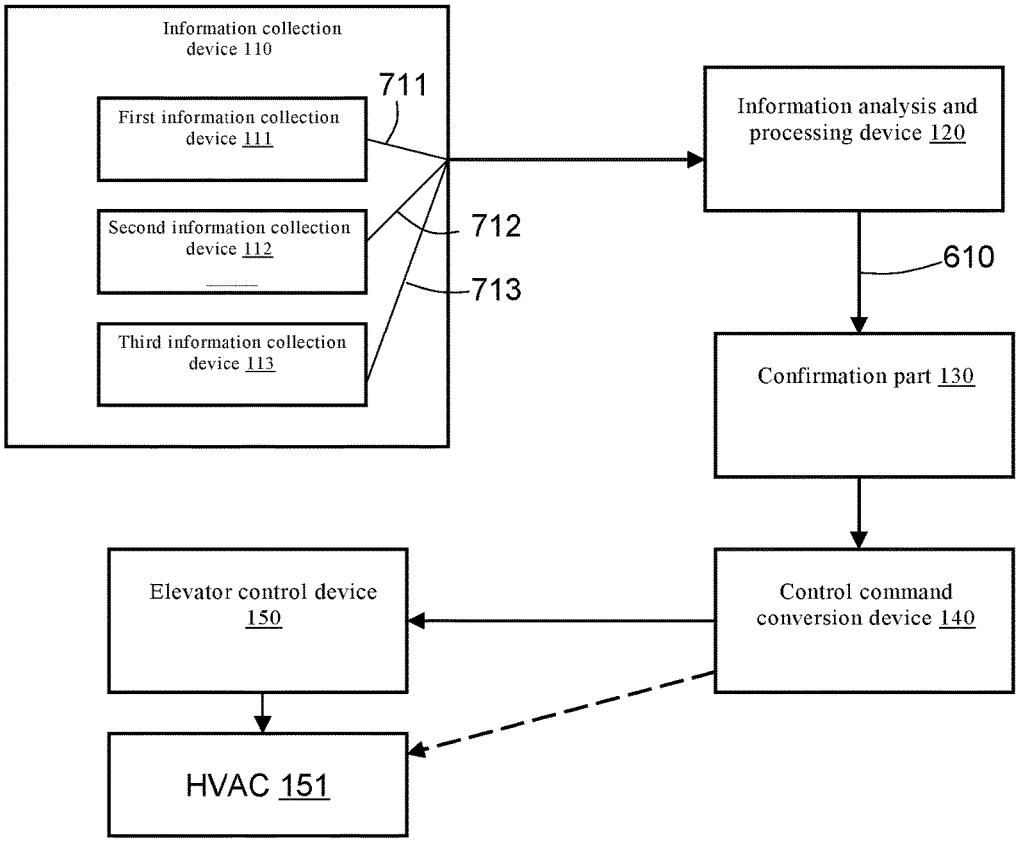
FIG. 1 illustrates the modular structure of an elevator system in an embodiment of the present invention.

FIG. 1 illustrates the modular structure of an elevator system in an embodiment of the present invention. In said embodiment, the elevator system mainly comprises an information collection device 110, the information collection device 110 may be installed in a passenger waiting area and an elevator system car 190, or may be carried by a passenger, or may even be installed in a passenger arriving area. In one embodiment, the information collection device 110 comprises a first information collection device 111, a second information collection device 112, and a third information collection device 113, which correspond to the passenger waiting area, the car interior, and the passenger arriving area, respectively.

Figure 2:
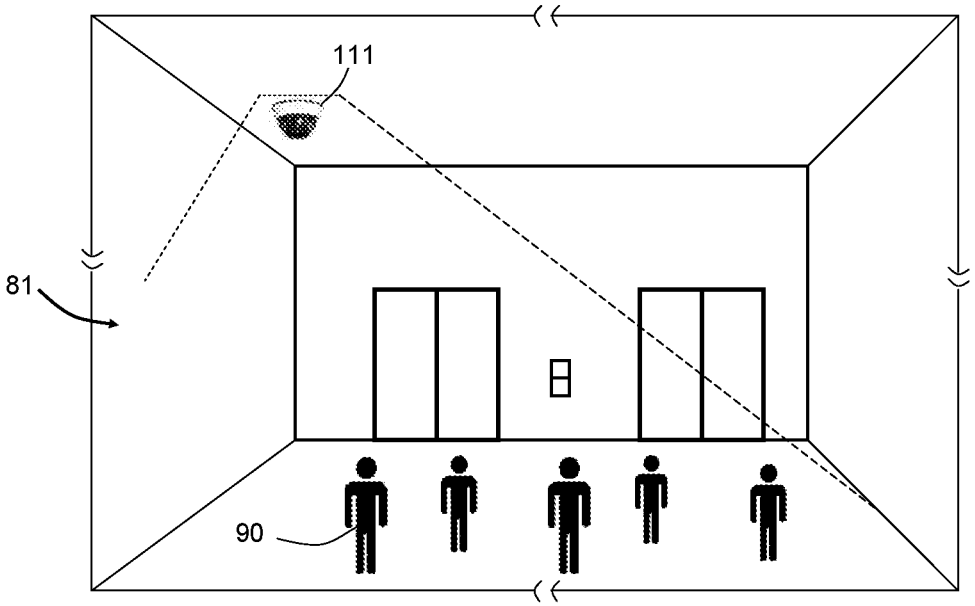
FIG. 2 illustrates an installation example of the first information collection device.
Figure 3:
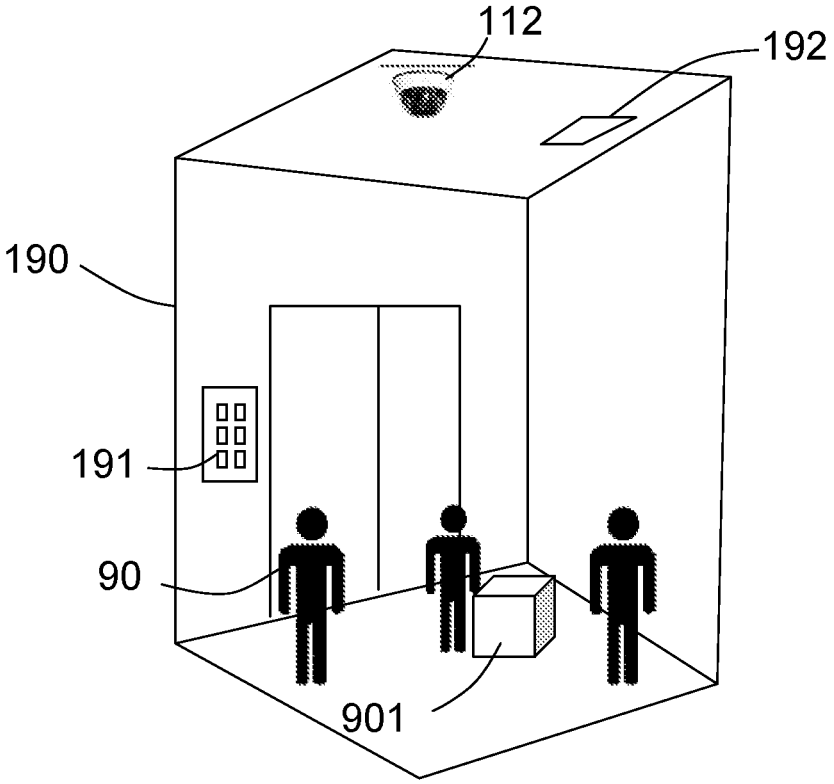
FIG. 3 illustrates an installation example of the second information collection device.
Figure 4:
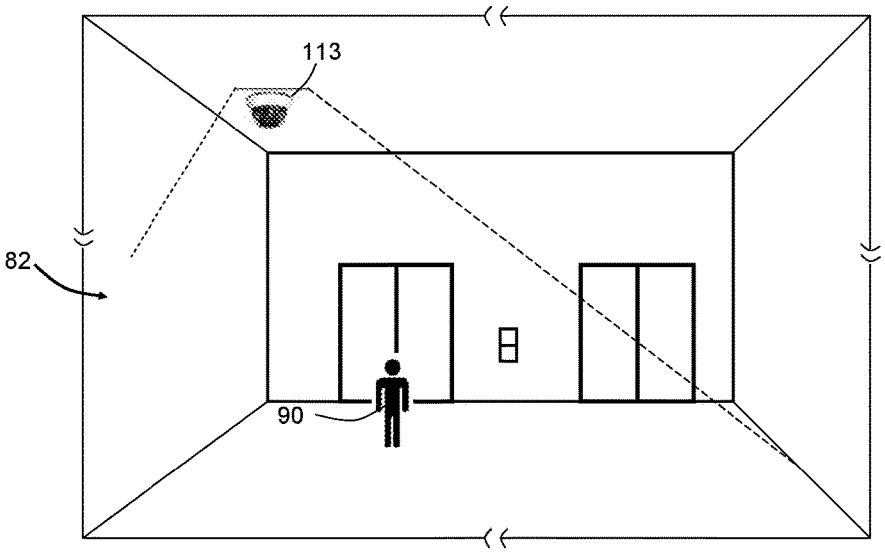
FIG. 4 illustrates an installation example of the third information collection device.

FIG. 2 illustrates an installation example of the first information collection device; FIG. 3 illustrates an installation example of the second information collection device; and FIG. 4 illustrates an installation example of the third information collection device. Referring to both FIG. 1 and FIG. 2, one or more passengers 90 may be present in the passenger waiting area 81 during a time period, and certainly, the passengers 90 are of different identities, and may comprise children, seniors and adults, and may also comprise VIPs or non-VIPs. As a result, passengers of different types have different demands for riding an elevator. The first information collection device 111 is installed in the passenger waiting area 81, which can collect relevant information of the passengers 90 within the monitoring range thereof so as to acquire passenger characteristic information 711, the passenger characteristic information 711, for example, includes but is not limited to the number of passengers waiting for an elevator, information of sounds made by passengers, time information, passenger body shape information, shapes of articles carried by the passengers, passenger crowd density and/or passenger identity information.

Referring to both FIG. 1 and FIG. 3, one or more passengers 90 may be present in the car 190 of the elevator system during a time period, the second information collection device 112 is installed inside the car 190, which can collect relevant information of the passengers 90 inside the car 190 so as to acquire passenger characteristic information 712, the passenger characteristic information 712, for example, includes but is not limited to the number of passengers riding the elevator, information of sounds made by passengers, time information, shapes of articles carried by the passengers, passenger crowd density and/or passenger identity information.

In one embodiment, the first information collection device 111/the second information collection device 112 may be one or more 3D sensors, for example, RGB-D (three primary colors plus distance) sensors, or may be 2D smart IP cameras. Along with increasingly extensive applications of various smart terminals in passengers, moreover, it is possible to conveniently acquire passenger identity information by an elevator system. Therefore, the first information collection device 111/the second information collection device 112 may also be wearable smart terminals (not shown) carried by passengers, the smart terminals may, for example, include but are not limited to RFID cards, smart phones or smart wearable devices, which can at least store passenger characteristic information of passengers, for example labeling a passenger's VIP identity information. By providing a corresponding device for reading the smart terminals in an elevator system, passenger identity information can be conveniently acquired when a passenger places a smart terminal close to the device. The applicant understands that a smart terminal is more accurate and convenient than a 3D sensor or a 2D smart IP camera in terms of acquiring passenger identity information. In another embodiment, therefore, the first information collection device 111/the second information collection device 112 may be a combination of any one of the 3D sensor and the 2D smart IP camera with a smart terminal carried by a passenger.

As shown in FIG. 1 and FIG. 4 again, one or more passengers 90 may come out of the car during a time period in the passenger arriving area 82, and certainly, the passengers 90 are of different identities, and may comprise VIP. In the embodiment, a corresponding VIP service is provided to VIPs, the third information collection device 113 is installed in the passenger arriving area 82, which can collect relevant information of the arriving passengers 90 within the monitoring range thereof so as to acquire passenger characteristic information 713, and the passenger characteristic information 713, for example, includes but is not limited to passenger identity information, etc.

By considering that the passenger arriving area 82 may also function as a passenger waiting area of the same floor, the third information collection device 113 may be set to be the same as the first information collection device 111. In one embodiment, the third information collection device 113 may be a 3D sensor or a 2D smart IP camera, which can perform facial image acquisition and face recognition on the arriving passengers 90, thereby acquiring passenger characteristic information 713; in another alternative embodiment, the third information collection device 113 may be a smart terminal such as a RFID card, and passenger characteristic information 713 related to the identity information of the passengers 90 may be acquired by directly reading the smart terminal. In such a way, corresponding special services will be provided later for the subsequent elevator rides of the VIP.

It should be noted that the specific installation position of the first information collection device 111, the second information collection device 112, and/or the third information collection device 113 is not restrictive, and they can be specifically installed for more accurately acquiring passenger characteristic information.

As shown in FIG. 1 again, the elevator system mainly comprises an information analysis and processing device 120, the passenger characteristic information 711, the passenger characteristic information 712, and the passenger characteristic information 713 acquired from the information collection device 110 are sent to the information analysis and processing device 120, and the information analysis and processing device 120 performs analysis and processing on them. The information analysis and processing device 120 may be set up collectively, or may be set up separately to correspond to each information collection device. In an example where all of the information collection devices 110 are RGB-D sensors, the information analysis and processing device 120 may be a PC server corresponding to the RGB-D sensors, various image information that has been collected is transmitted to the PC server for in-depth analysis and processing so as to acquire intermediate processing information, and based on the intermediate processing information, a corresponding control command 610 is generated. The information analysis and processing device 120 is a core part of a smart control elevator system, and personalized excellent riding experience can be provided to passengers through different control commands 610 sent thereby. The information analysis and processing device of an elevator system in embodiments of the present invention will be exemplarily described in detail below with reference to FIG. 1 through FIG. 7, and at the same time, a control method of the elevator system will be described exemplarily.

Figure 5:
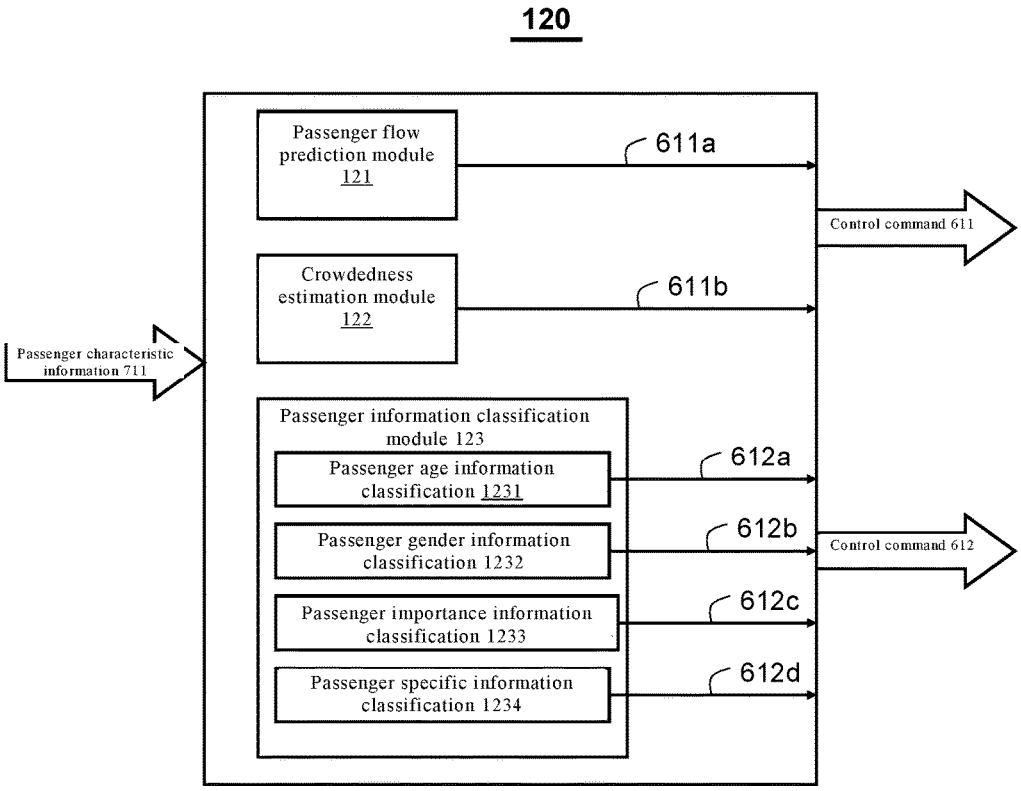
FIG. 5 is a schematic diagram of the working principle of an information analysis and processing device in an embodiment corresponding to the passenger waiting stage.
Figure 6:
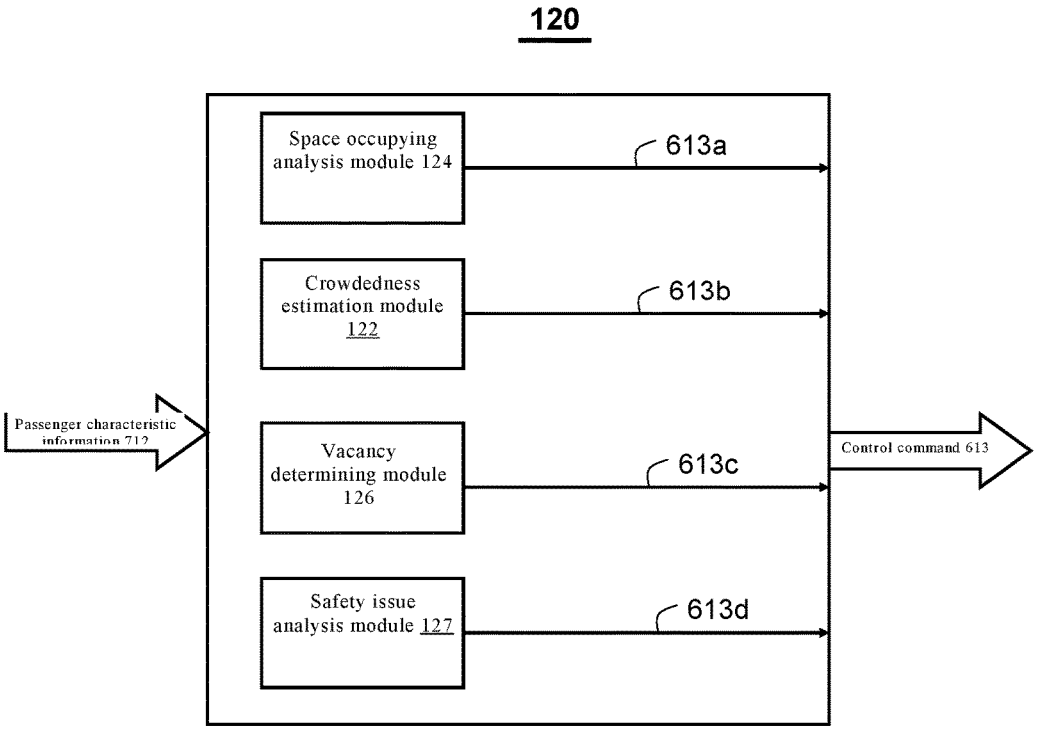
FIG. 6 is a schematic diagram of the working principle of an information analysis and processing device in an embodiment corresponding to the passenger riding stage.
Figure 7:
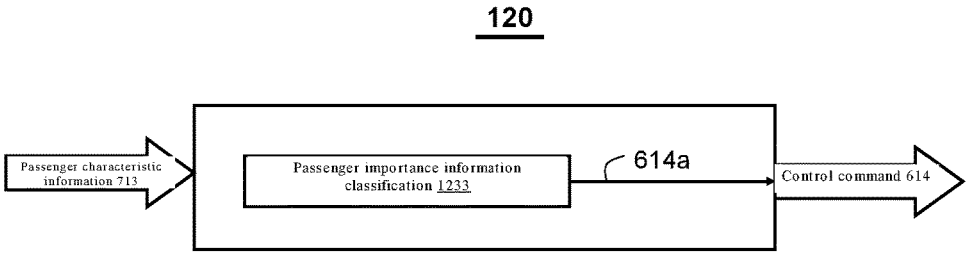
FIG. 7 is a schematic diagram of the working principle of an information analysis and processing device in an embodiment corresponding to the passenger arriving stage.

FIG. 5 is a schematic diagram of the working principle of an information analysis and processing device in an embodiment corresponding to the passenger waiting stage; FIG. 6 is a schematic diagram of the working principle of an information analysis and processing device in an embodiment corresponding to the passenger riding stage; and FIG. 7 is a schematic diagram of the working principle of an information analysis and processing device in an embodiment corresponding to the passenger arriving stage.

Referring to FIG. 1, FIG. 2, and FIG. 5, passengers 9 are at the waiting stage in an elevator waiting area 81, and the passenger characteristic information 711 is sent to the information analysis and processing device 120. The information analysis and processing device 120 performs, at least based on the passenger flow quantity-time distribution information, passenger flow prediction so as to transmit a control command for dispatching an elevator in advance. The passenger characteristic information 711 may comprise the passenger flow quantity-time distribution information, and correspondingly, the information analysis and processing device 120 is provided with a passenger flow prediction module 121. According to the passenger flow quantity-time distribution information acquired within a long time period, for example, a passenger flow quantity curve, the passenger flow prediction module 121 may predict, based on the passenger flow quantity-time distribution information, the amount of passengers in the next time period, and consequently can perform passenger flow prediction, and the passenger flow prediction module 121 further transmits a command 611*a* for dispatching an elevator in advance. When elevator passengers in a building are substantially fixed (e.g. an office building), in particular, certain regularities exist in activities of the elevator passengers. As a result, peaks and valleys of elevator rides can be accurately predicted, and the command 611*a* can be transmitted prior to an elevator riding peak for dispatching an elevator in advance to a passenger waiting area on corresponding floors, which is favorable for shortening the waiting time of passengers and improving the operating efficiency of elevators. Even when elevator passengers in a building are relatively not fixed, the passenger flow prediction module 121 may certainly perform analysis based on historical data, consequently acquire the passenger flow quantity-time distribution information having certain regularities, and transmit, based on the passenger flow quantity-time distribution information, a command 611*a* prior to an elevator riding peak for dispatching an elevator in advance.

Referring to FIG. 1, FIG. 2, and FIG. 5 again, the information analysis and processing device 120 further comprises a crowdedness estimation module 122, the passenger characteristic information 711 may comprise the passenger amount and density information for the current time period, and consequently can perform analysis and processing, based on the passenger characteristic information 711, so as to acquire passenger crowdedness estimation information of the passenger waiting area 81, and is further used for transmitting, based on the passenger crowdedness estimation information, a command 611*b*, the command 611*b* may be a command for accelerating the dispatching of an elevator to the passenger waiting area and/or increasing the amount of elevators dispatched to the passenger waiting area. In such a way, the waiting time of passengers can be shortened and the operating efficiency of elevators can be improved when many passengers are waiting.

The commands 611*a* and 611*b* in the above embodiment primarily form the control command 611, which is transmitted by the information analysis and processing device 120 to a confirmation part 13.

Referring to FIG. 1, FIG. 2, and FIG. 5 again, in the embodiment, the information analysis and processing device 120 performs classification on passengers, and correspondingly, the information analysis and processing device 120 is provided with a passenger information classification module 123 therein, the passenger information classification module 123 performs analysis and processing on the passenger characteristic information 711 so as to at least acquire passenger classification information. In one embodiment, the passenger information classification module 123 may be provided with one or more of a passenger age information classification sub-module 1231, a passenger gender information classification sub-module 1232, a passenger importance information classification sub-module 1233 and a passenger specific information classification sub-module 1234 therein.

Specifically, the passenger age information classification sub-module 1231 is used for performing analysis and processing on the passenger characteristic information 711, for example, performing analysis and processing on passenger body shape information in the passenger characteristic information 711, and consequently substantially identifying whether each passenger is one of three passenger classifications of children, adults and seniors, thereby acquiring classification information of children, adults and seniors. When the classification information at least comprises senior classification information, it can be determined that the currently waiting passengers comprise seniors. At this moment, the passenger age information classification sub-module 1231 transmits a command 612*a* for extending the elevator car door open and wait time and/or slowing down the elevator car door closing speed. As a result, senior passengers can be provided with a good user experience, and dangerous accidents can be prevented. When the classification information is only children classification information, it can be determined that the currently waiting passengers are children and that they are not accompanied by corresponding guardians. At this moment, the passenger age information classification sub-module 1231 transmits a command 612*a* for ignoring an elevator call request from the current passenger waiting area. As a result, children can be directly prevented from riding an elevator alone, and dangerous accidents can be prevented in advance.

Specifically, the passenger gender information classification sub-module 1232 is used for performing analysis and processing on the passenger characteristic information 711 so as to acquire classification information of males and females, for example, performing analysis and processing on passenger body shape information in the passenger characteristic information 711, and consequently substantially identifying the gender of each passenger. The classification information may be, but is not limited to, the amounts of current male/female passengers and the amount ratio of male to female passengers. The passenger gender information classification sub-module 1232 further transmits, based on the ratio of male to female classification information, a command 612*b* for controlling contents played by display devices in the passenger waiting area and/or cars. For example, based on the command 612*b*, when the classified female passengers are more than the classified male passengers, display devices in the passenger waiting area and/or cars to arrive soon may be switched to playing entertainment news, advertisements or shopping guide information, and when the classified male passengers are more than the classified female passengers, display devices in the passenger waiting area and/or cars to arrive soon may be switched to playing sports news. In such a way, based on the command 612*b*, the played contents are applicable for most passengers, leading to a better experience.

Specifically, the passenger importance information classification sub-module 1233 is used for performing analysis and processing on the passenger characteristic information 711 so as to acquire classification information of VIPs and non-VIPs. For example, a building's management staff may issue corresponding RIFD cards or smart devices to a VIP or the entourage thereof to identify their identity information. When the VIP swipes the card to take an elevator, the passenger characteristic information 711 will comprise the identity information thereof, and consequently the classification information that they belong to VIPs can be rapidly recognized. When the classification information acquired by the passenger importance information classification sub-module 1233 at least comprises VIP classification information, it indicates that a VIP currently needs to take an elevator, and the passenger importance information classification sub-module 1233 transmits a command 612*c* for dispatching a special elevator to the passenger's waiting area, and in such a way, the VIP is provided with excellent riding experience.

Specifically, the passenger specific information classification sub-module 1234 is used for performing analysis and processing on the passenger characteristic information 711 so as to acquire classification information of specific passengers, including disabled people, people carrying strollers, or people carrying large luggage or luggage carts, and consequently can rapidly recognize specific passengers currently present in the waiting hall and in need of specific riding services, such as disabled people, the passenger specific information classification sub-module 1234 can transmit a command 612*d*, the command 612*d* is, for example, used for dispatching a special elevator to the passenger waiting area, and in another example, is used for extending the elevator car door open and wait time and/or slowing down the elevator car door closing speed. In such a way, excellent riding experience can be provided to specific passengers.

The above commands 612*a*, 612*b*, and 612*c* primarily form the control command 612, which is transmitted by the information analysis and processing device 120 to a confirmation part 130. Among the commands 612*a*, 612*b*, and 612*c*, different cars can be controlled simultaneously, or the same car may be dynamically controlled in different time periods. With the presence of various commands 612*a* and 612*b*, commands applicable for corresponding classified passengers may be transmitted according to passenger characteristic information, and personalized user experience may be provided to various classified passengers.

Referring to FIG. 1, FIG. 3, and FIG. 6, at the riding stage that passengers 90 are inside the car 190, the passenger characteristic information 712 is transmitted to the information analysis and processing device 120. According to the prior art, if passengers inside a car are overweight, it indicates that an overloading action has taken place, and consequently elevator call requests from other floors will be ignored in the subsequent operating process. However, the present application considers that, as shown in FIG. 3, a passenger 90 inside the car 190 may carry an article 901, such as luggage or stroller. The carried article 901 tends to take up a big space inside the car. As a result, it is often the case that the elevator is not overloaded, but the car 190 actually has been filled up by passengers and articles 901 carried thereby, such that subsequently no more passengers can actually ride the elevator.

In one embodiment, occupied space information is collected by the second information collection device 112 as a part of the passenger characteristic information 712, and at the same time, a space occupying analysis module 124 is introduced into the information analysis and processing device 12, which may realize that, when a car space has been fully occupied, elevator call requests from other floors passed by are ignored. Specifically, the space occupying analysis module 124 performs analysis, at least based on the occupied space information (e.g. analyzing the space occupied by a carried article 910 when said carried article is present) in the passenger characteristic information 712, to obtain a space occupying degree of the car 190, it indicates that the car has been fully occupied when the space occupying degree is equal to or greater than a predetermined value, and at this moment, it may be indicated that the car is "fully loaded", then the space occupying analysis module 124 transmits a command 613*a* for ignoring elevator call requests from other floors. In such a way, the command 613*a* can be adjusted according to the real-time space occupying situation of the car 190, which prevents unnecessary operational interruption to the car 19, improves the operating efficiency of elevators, and also improves passenger experience.

It should be understood that, in other embodiments, the current loading information of a car may be further combined, i.e. the space occupying information and the current loading information are combined, to determine if it is "fully loaded", when any one of the two conditions is equal to or greater than its corresponding predetermined value, or when both of the two conditions are equal to or greater than their respective corresponding predetermined values, it can be used to indicate that the car is "fully loaded".

Referring to FIG. 1, FIG. 3, and FIG. 6 again, the crowdedness estimation module 122 comprised in the information analysis and processing device 120 is further used for performing analysis and processing, based on the passenger characteristic information 712, so as to acquire passenger crowdedness estimation information inside the car 190, and further for transmitting, based on the passenger crowdedness estimation information, a command 613*b* for controlling an air conditioning device in the car. The passenger crowdedness estimation information can reflect the degree of crowdedness inside the car 190. When there are crowded people, the requirements for controlling the air and temperature inside the car 190 are higher. The degree of crowdedness is determined based on the passenger crowdedness estimation information, for example, when the passenger crowdedness estimation information is greater than or equal to a predetermined value, the command 613*b* is transmitted to the HVAC (heating, ventilation and air conditioning) system 151 of the elevator system, to transport more fresh air and increase cooling or heating power by controlling the air conditioning device in the car 190. It should be noted that the command 613*b* may be dynamically adjusted in real time according to the passenger crowdedness estimation information obtained from the analysis. As a result, the degree of comfort is greatly improved for passengers.

It should be noted that the HVAC system 151 is directly coupled to the elevator control device 150 in the embodiment shown in FIG. 1; in another alternative embodiment, the HVAC system 151 may be directly coupled to the control command conversion device 140 (see the dotted line connection in FIG. 1), and at this moment, the HVAC system 151 may be deemed as installed inside the elevator control device 150; in yet another alternative embodiment, the HVAC system 151 may be coupled to a building centralized management and control platform, the elevator control device 150 is also coupled to the building centralized management and control platform, and the elevator control device 150 and the HVAC system 151 are indirectly coupled via the building centralized management and control platform. The specific form of distribution and setup of the HVAC system 151 is not limited to the above embodiments.

Referring to FIG. 1, FIG. 3, and FIG. 6 again, the information analysis and processing device 120 further comprises a vacancy determining module 126, which receives the passenger characteristic information 712, performs analysis and processing based on the passenger characteristic information 712, and then determines whether a passenger 90 is present in a car 19, and further transmits, when there is no passenger in the car 190, a command 613*c* for ignoring a transport request from the car. In such a way, even when an incorrect transport request command exists on the panel 191 inside the car 190, for example, transport requests for some floors are still activated on the panel 191 when there is no one inside the car 190, and at this moment, it can be intelligently determined, by the vacancy determining module 126, that said transport requests are actually invalid when no passenger 90 is currently present in the car 190. As a result, the command 613*c* is transmitted for ignoring the activated transport requests inside the car to avoid unnecessary operations, improve the efficiency and save energy.

Furthermore, to save energy, when it is determined that no passenger is present in the car 190, the vacancy determining module 126 further transmits the command 613*c* for turning off or dimming an illuminating device 192 in the car.

Referring to FIG. 1, FIG. 3, and FIG. 6 again, the information analysis and processing device 120 is further provided with a safety issue analysis module 127, which receives the passenger characteristic information 712, performs analysis and processing based on the passenger characteristic information 712, and then determines the safety situation of a passenger 90 in a car 190, the safety issue analysis module 127 further transmits, when the passenger is determined to be in an unsafe situation, a command 613*d* for at least outputting an alarm. Specifically, the unsafe situation may include, but is not limited to, criminal acts against a passenger, abnormal sound from a passenger (e.g. crying, screaming, etc.), a child taking the elevator alone, a passenger falling, etc. Information, such as sounds made by passengers, body shapes, on/off of lights, etc., can be collected by the 3D sensor or SMART IP CAMERA in the second information collection device 112 as the passenger characteristic information 712. It should be understood that, according to specific definitions of unsafe situations that require an alarm, the passenger characteristic information 712 comprising different information can be collected for analysis and processing so as to acquire relatively accurate determination of safe situations.

By promptly transmitting the command 613*d*, it facilitates a prompt alarm and promptly prevents unsafe situations from occurring.

Furthermore, the command 613*d* transmitted by the safety issue analysis module 127 can further control an elevator to a predetermined floor. In such a way, when a passenger 90 in a car 190 is determined to be in an unsafe situation, the elevator automatically runs to a relatively safe predetermined floor, which facilitates prompt gathering actions and ensures passenger safety.

The commands 613*a*, 613*b*, 613*c*, and 613*d* in the above embodiment primarily form the control command 613, which is transmitted by the information analysis and processing device 120 to a confirmation part 130 (see FIG. 1).

Referring to FIG. 1, FIG. 4, and FIG. 7, at the arriving stage that passengers 90 are in the arriving area 82, the passenger characteristic information 713 acquired by the third information collection device 113 is transmitted to the information analysis and processing device 120. The information analysis and processing device 120 may be further provided with the passenger importance information classification sub-module 1233, which can further perform analysis and processing on the third passenger characteristic information 1233 so as to acquire classification information of VIPs and non-VIPs. In such a way, identity confirmation can be performed on the passengers 90 walking out of the car, and when the classification information at least comprises VIP classification information, it indicates that a VIP passenger arrives at the floor, the passenger importance information classification sub-module 1233 transmits a command 614*a* for dispatching a special elevator to the corresponding floor of the passenger's arriving area. In such a way, an efficient service is provided for the VIP passenger to take an elevator again, and the riding experience thereof is improved. In the above embodiment, when a special elevator is dispatched to serve a VIP passenger, a car 190 that is determined to be vacant by the vacancy determining module 126 can be dispatched to a corresponding waiting area or arriving area, which does not affect to the overall transport efficiency of an elevator relatively.

The command 614 in the above embodiment primarily forms the control command 613, which is transmitted by the information analysis and processing device 120 to a confirmation part 130 (see FIG. 1).

As shown in FIG. 1 again, in the elevator system of the embodiment, it is further provided with a confirmation part 130. To implement confirmation of determination of any one or more situations illustrated above by each module or sub-module of the information analysis and processing device 120 and to prevent incorrect actions by the elevator system, the confirmation part 130 is provided for manual confirmation. Specifically, the confirmation part 130 performs manual determination, based on the first passenger characteristic information and/or the second passenger characteristic information acquired by the first information collection device and/or the second information collection device, respectively, whether to stop a corresponding command transmitted by the information analysis and processing device 120, for example, to stop any one or more of the control commands 611, 612, and 613 from being further transmitted to the elevator control device 150. With the command 613*d* transmitted by the safety issue analysis module 127 as an example, the command 613*d* is transmitted to the confirmation part 130, the acquired passenger characteristic information 712 in the car 190, such as video information, is also directly or indirectly transmitted to the confirmation part 130, an operator determines, through the display of the passenger characteristic information 712 on the display interface of the confirmation part 130, whether the command 613*d* fits the current actual situation in the car 190, if it does not fit, stops the transmission of the command 613*d*, and prevents false alarm and other operations.

As shown in FIG. 1 again, in the elevator system of the embodiment, optionally, it is further provided with a control command conversion device 140, the control command conversion device 140 receives one or more commands in the control command 610 from the information analysis and processing device 120, and converts them to command messages readable by the elevator control device 150. The provision of the control command conversion device 140 makes it easy to implement transformation of existing elevator systems such that they are compatible with the information analysis and processing device 120 of the elevator system according to the present invention.

As shown in FIG. 1 again, in the elevator system of the embodiment, it comprises the elevator control device 150, which is a control center of the elevator system and corresponds to various commands so as to transmit commands for controlling various parts of the elevator system to act. Specific types and configurations of the elevator control device 150 are not restrictive.

It should be noted that "passenger characteristic information" in the present invention is not limited to body information of a "passenger", and all characteristic information that is related to the passenger, such as clothing, carried articles, characteristics of the environment in which the passenger is located, etc., can be construed as the "passenger characteristic information".

It should be understood that, when it is claimed that a part is "connected" or "coupled" to another part, it may be directly connected or coupled to another part, or an intermediate part may be present. On the contrary, when it is claimed that a part is "directly connected" or "directly coupled" to another part, no intermediate part is present.

The above examples mainly describe the elevator system and the control method thereof according to the present invention. although only some of embodiments of the present invention are described, those skilled in the art should understand that the present invention may be implemented in many other forms without departing from the spirit and range thereof. For example, a module or sub-module of the information analysis and processing device 120 illustrated in FIG. 5 and FIG. 6 is deleted. Therefore, the illustrated examples and embodiments are construed as exemplary, rather than limiting. The present invention may encompass various modifications and substitutions without departing from the spirit and range of the present invention defined by the appended claims.

What is claimed is:

1. An elevator system, comprising a car and an elevator control device, the system comprising:

a first information collection device that is disposed in a passenger waiting area of the elevator system and used for at least acquiring first passenger characteristic information of the passenger waiting area;

a second information collection device that is used for at least acquiring second passenger characteristic information inside the car;

an information analysis and processing device that at least receives the first passenger characteristic information and the second passenger characteristic information, is configured to perform analysis and processing, at least based on the first passenger characteristic information, so as to transmit a first control command for dispatching the elevator to the elevator control device, is configured to perform analysis and processing on the first passenger characteristic information so as to at least acquire classification information of a passenger and to further transmit, based on the classification information, a second control command that is applicable for passengers in a corresponding classification to the elevator control device, and is further configured to dynamically transmit, based on the second passenger characteristic information, a third control command to the elevator control device;

wherein the information analysis and processing device comprises a passenger gender information classification sub-module, which is used for performing analysis and processing on the first passenger characteristic information so as to acquire classification information of males and females.

2. The elevator system according to claim 1, wherein the first information collection device/the second information collection device is a 3D sensor, a 2D smart IP camera or a wearable smart terminal carried by a passenger, or a combination of any one of the 3D sensor and the 2D smart IP camera with a wearable smart terminal carried by a passenger, wherein the wearable smart terminal at least stores identity information of passengers.

3. The elevator system according to claim 2, wherein the wearable smart terminal is a RFID card, a smart phone or a smart wearable device.

4. The elevator system according to claim 2, wherein the first passenger characteristic information regarding whether the passenger is VIP is acquired through the identity information stored in the smart terminal.

5. The elevator system according to claim 1, characterized in that the first passenger characteristic information comprises passenger flow quantity-time distribution information;

the information analysis and processing device comprises:

a passenger flow prediction module, which performs, at least based on the passenger flow quantity-time distribution information, passenger flow prediction so as to transmit a first control command for dispatching an elevator in advance.

6. The elevator system according to claim 1, wherein the information analysis and processing device comprises:

a first crowdedness estimation module, which is used for performing analysis and processing, based on the first passenger characteristic information, so as to acquire passenger crowdedness estimation information of the passenger waiting area, and is further used for transmitting, based on the passenger crowdedness estimation information, a first control command for accelerating the dispatching of an elevator to the passenger waiting area and/or increasing the amount of elevators dispatched to the passenger waiting area.

7. The elevator system according to claim 1, wherein the information analysis and processing device comprises one or more of:

a passenger information classification module, configured to perform analysis and processing on the first passenger characteristic information so as to at least acquire passenger classification information, the passenger information classification module further comprises one or more of the following sub-modules:

a passenger age information classification sub-module, which is used for performing analysis and processing on the first passenger characteristic information so as to acquire classification information of children, adults and seniors;

a passenger importance information classification sub-module, which is used for performing analysis and processing on the first passenger characteristic information so as to acquire classification information of VIPs and non-VIPs;

a passenger specific information classification sub-module, which is used for performing analysis and processing on the first passenger characteristic information so as to acquire classification information of specific passengers, including disabled people, people carrying strollers, or people carrying large luggage or luggage carts.

8. The elevator system according to claim 7, wherein the passenger age information classification sub-module is configured to:

transmit, when the classification information is only children classification information, a second control command for ignoring an elevator call request from the current passenger waiting area.

9. The elevator system according to claim 7, wherein the passenger age information classification sub-module is configured to:

transmit, when the classification information at least comprises seniors and/or specific passenger classification information, a second control command for extending the elevator car door open and wait time and/or slowing down the elevator car door closing speed.

10. The elevator system according to claim 7 wherein the passenger importance information classification sub-module is configured to:

transmit, when the classification information at least comprises VIP or specific passenger classification information, a second control command for dispatching a special elevator to the passenger waiting area.

11. The elevator system according to claim 1, wherein the passenger gender information classification sub-module is configured to:

transmit, based on the ratio of male to female classification information, a second control command for controlling contents played by display devices in the passenger waiting area and/or cars.

12. The elevator system according to claim 1, wherein the second passenger characteristic information comprises occupied space information; the information analysis and processing device comprises:

a space occupying analysis module, which performs analysis, at least based on the occupied space information in the second passenger characteristic information, to obtain a space occupying degree of a car, then transmits a third control command for ignoring elevator call requests from other floors when the space occupying degree is equal to or greater than a predetermined value.

13. An elevator system, comprising a car and an elevator control device, the system comprising:

a first information collection device that is disposed in a passenger waiting area of the elevator system and used for at least acquiring first passenger characteristic information of the passenger waiting area;

a second information collection device that is used for at least acquiring second passenger characteristic information inside the car;

an information analysis and processing device that at least receives the first passenger characteristic information and the second passenger characteristic information, is configured to perform analysis and processing, at least based on the first passenger characteristic information, so as to transmit a first control command for dispatching the elevator to the elevator control device, is configured to perform analysis and processing on the first passenger characteristic information so as to at least acquire classification information of a passenger and to further transmit, based on the classification information, a second control command that is applicable for passengers in a corresponding classification to the elevator control device, and is further configured to dynamically transmit, based on the second passenger characteristic information, a third control command to the elevator control device;

wherein the information analysis and processing device comprises:

a second crowdedness estimation module, which is used for performing analysis and processing, based on the second passenger characteristic information, so as to acquire passenger crowdedness estimation information of a car, and is further used for transmitting, based on the passenger crowdedness estimation information, a third control command for controlling an air conditioning device in the car.

14. The elevator system according to claim 1, wherein the information analysis and processing device comprises:

a vacancy determining module, which is used for determining, based on the second passenger characteristic information, whether a passenger is present in a car, and is further used for transmitting, when there is no passenger in the car, a third control command for ignoring a transport request from the car.

15. The elevator system according to claim 14, wherein the vacancy determining module is further used for transmitting, when there is no passenger in the car, a third control command for turning off or dimming an illuminating device in the car.

16. The elevator system according to claim 1, wherein the information analysis and processing device comprises:

a safety issue analysis module, which is used for performing analysis and processing, based on the second passenger characteristic information, to determine the safety situation of a passenger in a car, and is further used to transmit, when the passenger in the car is determined to be in an unsafe situation, a third control command for at least outputting an alarm.

17. The elevator system according to claim 16, wherein the safety issue analysis module is further used for transmitting, when the passenger in the car is determined to be in an unsafe situation, a third control command for controlling the elevator to a predetermined floor.

18. The elevator system according to claim 1, further comprising:

a control command conversion device, which is used for converting the first control command, the second control command and/or the third control command to a command message that is readable by the elevator control device.

19. The elevator system according to claim 1, further comprising:

a third information collection device that is disposed in a passenger arriving area of the elevator system and used for at least acquiring third passenger characteristic information of passengers from inside the car to the passenger arriving area;

wherein the information analysis and processing device comprises a passenger importance information classification sub-module, which is used for performing analysis and processing on the third passenger characteristic information so as to acquire classification information of VIPs and non-VIPs.

20. The elevator system according to claim 19, wherein the passenger importance information classification sub-module is configured to:

transmit, when the classification information at least comprises VIP classification information, a fourth control command for dispatching a special elevator to a floor corresponding to the passenger's arriving area.

* * * * *